US009985381B2

(12) United States Patent
Nguyen Nhu et al.

(10) Patent No.: US 9,985,381 B2
(45) Date of Patent: May 29, 2018

(54) WATERPROOF ELECTRICAL CONNECTOR HAVING A SEAL MOVABLE TO COVER A SEAL AND HAVING A CABLE RECESS

(71) Applicant: TE Connectivity Germany GmbH, Bensheim (DE)

(72) Inventors: Lam Nguyen Nhu, Bensheim (DE); Wolfgang Mueller, Darmstadt (DE); Andy Sattler, Heppenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days. days.

(21) Appl. No.: 15/462,453

(22) Filed: Mar. 17, 2017

(65) Prior Publication Data

US 2017/0271810 A1 Sep. 21, 2017

(30) Foreign Application Priority Data

Mar. 17, 2016 (DE) ..... 10 2016 104 992

(51) Int. Cl.

| | |
|---|---|
| ***H01R 13/52*** | (2006.01) |
| ***H01R 13/62*** | (2006.01) |
| ***H01R 24/38*** | (2011.01) |
| ***H01R 13/506*** | (2006.01) |
| *H01R 24/40* | (2011.01) |

(52) U.S. Cl.

CPC ..... *H01R 13/5205* (2013.01); *H01R 13/506* (2013.01); *H01R 13/5213* (2013.01); *H01R 13/6205* (2013.01); *H01R 24/38* (2013.01); *H01R 24/40* (2013.01); *H01R 2201/26* (2013.01)

(58) Field of Classification Search

CPC ..... H01R 13/5205; H01R 13/5219; H01R 13/5221; H01R 24/38

USPC ..... 439/271, 274, 275, 587

See application file for complete search history.

(56) References Cited

U.S. PATENT DOCUMENTS

| | | | | |
|---|---|---|---|---|
| 3,633,150 | A * | 1/1972 | Swartz | H01R 13/5221 439/135 |
| 4,497,531 | A | 2/1985 | Baker | |
| 5,569,051 | A * | 10/1996 | Endo | H01R 13/42 439/587 |
| 6,152,752 | A * | 11/2000 | Fukuda | H01R 13/506 439/274 |
| 6,217,394 | B1 * | 4/2001 | Sugie | H01R 13/5208 439/587 |
| 6,332,797 | B1 * | 12/2001 | Taguchi | H01R 13/5208 439/275 |
| 6,485,332 | B1 * | 11/2002 | Kwang | H01R 13/443 439/587 |

(Continued)

FOREIGN PATENT DOCUMENTS

| | | | |
|---|---|---|---|
| DE | 4015793 | A1 | 12/1990 |
| DE | 69522488 | T2 | 10/1995 |
| WO | 2010068291 | A1 | 6/2010 |

OTHER PUBLICATIONS

German Office Action, dated Nov. 16, 2016, 14 pages.

*Primary Examiner* — Chandrika Prasad

(74) *Attorney, Agent, or Firm* — Barley Snyder

(57) ABSTRACT

A housing assembly for a waterproof connector includes a housing, a sealing device, and a protective cover. The housing has a sealing chamber receiving a seal. The sealing device is movable to cover the seal in the sealing chamber. The protective cover covers the seal and the sealing device.

23 Claims, 8 Drawing Sheets

(56) References Cited

U.S. PATENT DOCUMENTS

| | | | | |
|---|---|---|---|---|
| 7,044,762 | B1 * | 5/2006 | Hong | H01R 13/5213 439/275 |
| 7,371,115 | B1 * | 5/2008 | Hsieh | H01R 13/5208 439/271 |
| 8,109,789 | B2 * | 2/2012 | Tyler | H01R 13/5205 439/587 |
| 2010/0151721 | A1 * | 6/2010 | Tyler | H01R 13/5205 439/465 |
| 2012/0129392 | A1 * | 5/2012 | Fujisaki | H01R 13/521 439/587 |
| 2012/0231676 | A1 * | 9/2012 | Picaud | H01R 4/34 439/807 |

* cited by examiner

WATERPROOF ELECTRICAL CONNECTOR HAVING A SEAL MOVABLE TO COVER A SEAL AND HAVING A CABLE RECESS

CROSS-REFERENCE TO RELATED APPLICATION

This application claims the benefit of the filing date under 35 U.S.C. § 119(a)-(d) of German Patent Application No. 102016104992.1, filed on Mar. 17, 2016.

FIELD OF THE INVENTION

The present invention relates to a waterproof electrical connector, and more particularly, to a housing assembly of a waterproof electrical connector.

BACKGROUND

Known electrical connectors transfer electrical currents, voltages, signals, and data with a large bandwidth of currents, voltages, frequencies, and data rates. In low, medium, or high voltage or current ranges, and in particular in the automotive industry, such connectors must guarantee the transfer of electrical power, signals, and data in hot, contaminated, humid, or chemically aggressive environments. Due to the large range of applications, a large number of specifically configured connectors are known.

Known electrical connectors throughout the range of applications have housings assembled with an electrical member, such as an electrical cable or a circuit board of an electrical component, for mating with a mating electrical connector. An electrical connector must reliably secure an electrical contact within the housing for connecting to the electrical member. Furthermore, the electrical connector must reliably transmit electrical signals, and consequently, known electrical connectors have fasteners for detachably fastening to the mating electrical connector. The housings of known electrical connectors are mostly subject to a particular standardization, for example the FAKRA standard, so the most important dimensions of the housings have the same dimensions with different manufacturers. Known electrical connectors, however, are too large and expensive to produce for a given maximum current load capacity of the cable. Furthermore, known miniaturized electrical connectors cannot pass a splash water test (IPX4 standard) or water jet test (IPX5 standard) which are required in particular in the automotive sector.

SUMMARY

An object of the invention, among others, is to provide a housing assembly for a waterproof electrical connector which has small dimensions. The housing assembly according to the invention includes a housing, a sealing device, and a protective cover. The housing has a sealing chamber receiving a seal. The sealing device is movable to cover the seal in the sealing chamber. The protective cover covers the seal and the sealing device.

BRIEF DESCRIPTION OF THE DRAWINGS

The invention will now be described by way of example with reference to the accompanying Figures, of which.

DETAILED DESCRIPTION OF THE EMBODIMENTS

Figure 1:
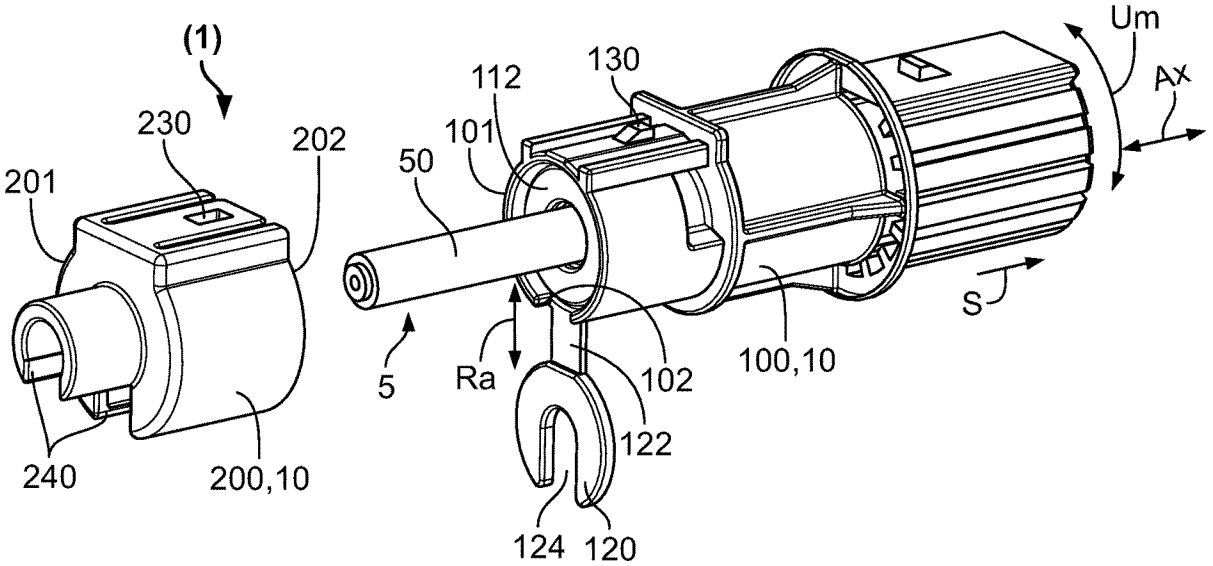
FIG. 1 is a perspective view of an electrical connector according to the invention in a pre-assembly state of a sealing device and a pre-assembly state of a protective cover.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

Figure 2:
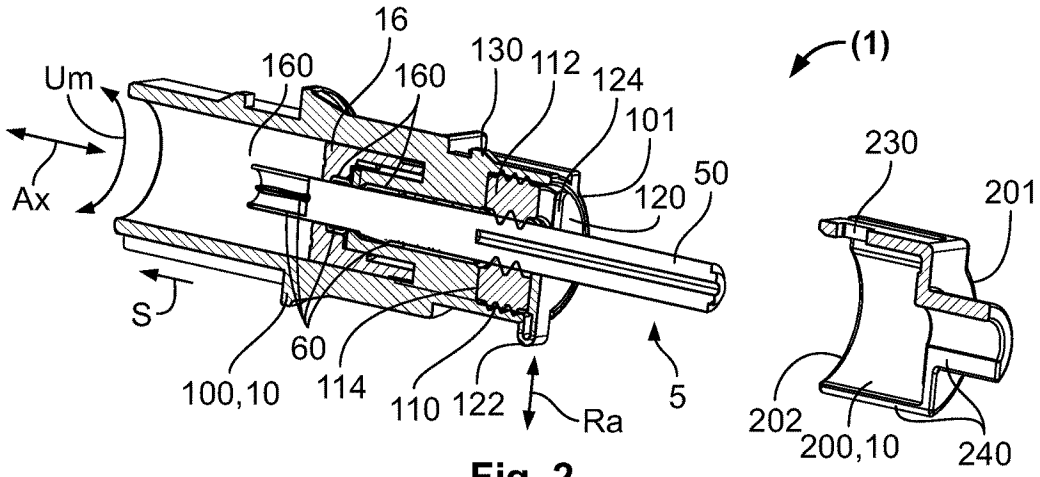
FIG. 2 is a sectional perspective view of the electrical connector of FIG. 1 in an assembled state of the sealing device and the pre-assembly state of the protective cover.
Figure 3:
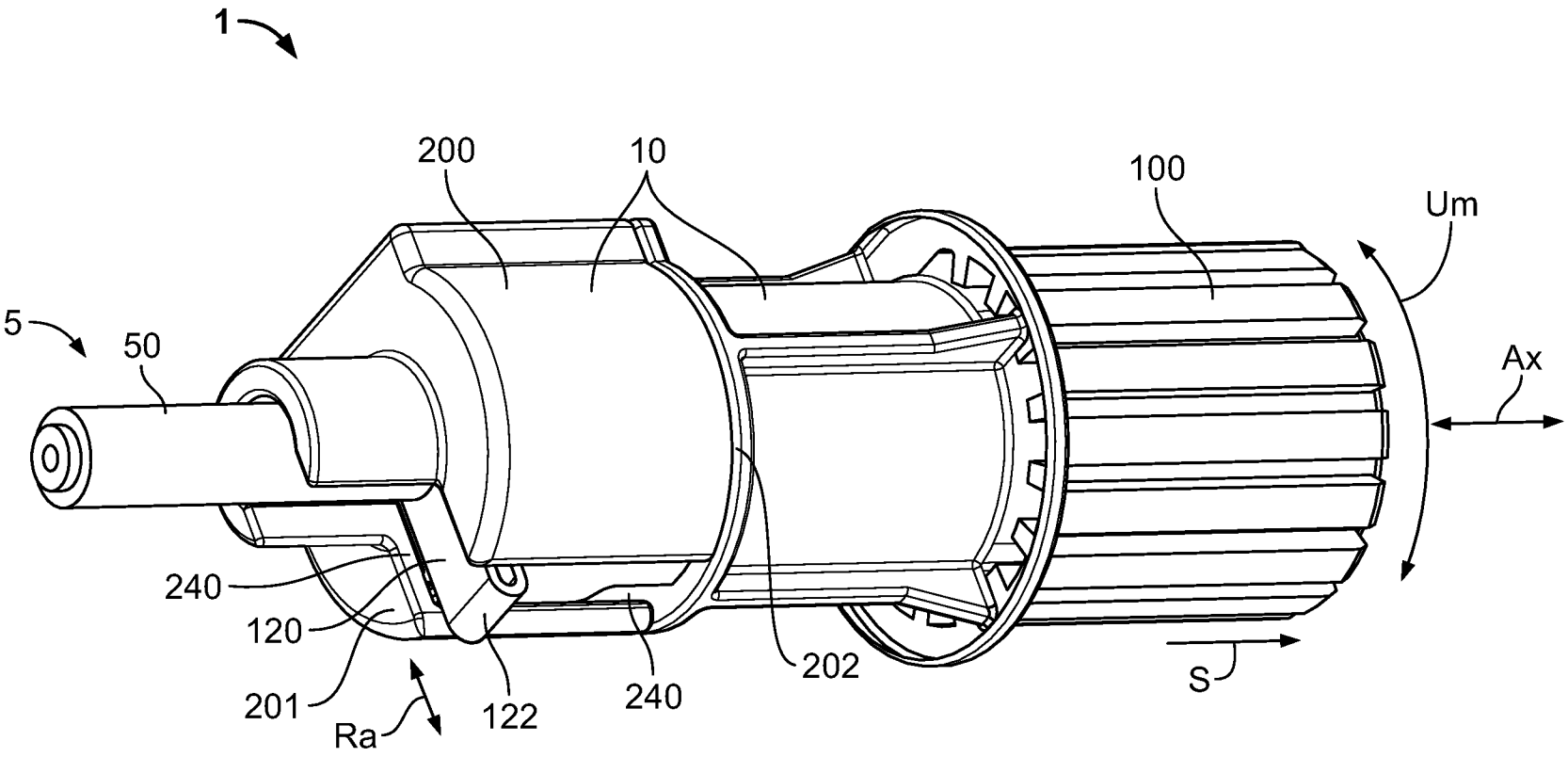
FIG. 3 is a perspective view of the electrical connector of FIG. 1 in a fully assembled state.

An electrical connector 1 according to a first embodiment of the invention is shown in FIGS. 1-3. The electrical connector 1 includes a housing assembly 10 and an assembled cable 5. In the embodiment of FIG. 1, the housing assembly 10 is a plug housing assembly and the electrical connector 1 is a plug connector. As would be understood by one with ordinary skill in the art, the housing assembly 10 could alternatively be a receptacle housing assembly and the electrical connector 1 could be a receptacle connector. The connector 1 in the embodiments described below is constructed in accordance with the FAKRA automotive standard.

The assembled cable 5 includes a cable 50 and a connection mechanism 60 electrically connected to the cable 50. The cable 50 is a coaxial cable and has a copper conductor or an aluminum conductor. The connection mechanism 60 has a ferrule, a first contact, and a second contact, each of which is crimpable.

The housing assembly 10 includes a housing 100 and a protective cover 200.

The housing 100, as shown in FIGS. 1 and 2, has a sealing chamber 110 open at a rear end 101 of the housing 100 in an axial direction Ax, the rear end 101 also being a cable outlet side of the housing 100. The sealing chamber 110 has a recess 102 at the rear end 101. The sealing chamber 110 is covered by the protective cover 200 at the rear end 101. The sealing chamber 110 is delimited internally in the housing 100 by a shoulder 114 in the axial direction Ax opposite the rear end 101. A seal 112, as shown in FIG. 2, is positioned at the shoulder 114. The cable 50 extends through the seal 112, and the seal 112 seals the cable 50 with respect to a contact chamber 160 of the housing 100. The connection mechanism 60 is disposed in the contact chamber 160 and is secured within the contact chamber 160 by a retainer 16 engaging the connection mechanism 60 and the housing 100. The housing 100 also has a housing catch 130 disposed on an outer surface thereof.

The protecting cover 200, as shown in FIGS. 1 and 2, has a rear end 201 and an opposite front end 202 in the axial direction Ax. The protecting cover 200 is open at the front end 202, and a cover catch 230 is disposed at the front end 202 on an outer wall of the protective cover 200. At the rear end 201, the protective cover 200 is closed except for a cable passageway 240 extending through the protective cover 200 in the axial direction Ax. The front end 202 is disposed over the rear end 101 of the sealing chamber 110. The protective cover 200 can be placed onto the cable 50 from a radial exterior Ra and can be pushed, in a chronological sequence, onto the housing 100. The protective cover 200 is fixed at the housing 100 by engagement of the housing catch 130 with the cover catch 230.

As a result of the cable recess 240 of the protective cover 200 extending from the radial exterior to the radial interior, the seal 112 in the sealing chamber 110 would be axially Ax accessible from the exterior at a rear of the seal 112, which may result in problems with water-tightness of the connector 1 in the case of water being sprayed from a corresponding direction. Accordingly, a sealing device 120 covers the rear of the seal 112. In the embodiment shown in FIGS. 1-3, the sealing device 120 is connected to the housing 100 via a hinge 122 at the rear end 101. In the shown embodiment, the sealing device 120 and the hinge 122 are planar.

In a pre-assembly state of the sealing device 120 shown in FIG. 1, the hinge 122 and the sealing device 120 extend radially Ra outward from the housing 100. In an assembled state of the sealing device 120, shown in FIG. 2, the sealing device 120 is folded onto the sealing chamber 110 approximately 180° about the hinge 122. A portion of the hinge 122 is received in the recess 102 in a positive-locking manner in a peripheral direction Um. A substantially circular or cylindrical outer periphery of the sealing device 120 is received in a positive-locking manner at or in the sealing chamber 110. The sealing device 120 is completely received within the sealing chamber 110 in the axial direction Ax of the housing. The sealing device 120 and the protective cover 200 apply a mechanical pretensioning force to the seal 112.

So that the sealing device 120 can readily be assembled over the cable 50, the sealing device 120 has a cable recess 124 which extends through the entire sealing device 120 in the axial direction Ax. The cable recess 124 is radial such that the sealing device 120 can be pushed over the cable 50 from an exterior of the cable 50 and can be received, in a chronological sequence, at or in the sealing chamber 110.

The protective cover 200 is subsequently assembled on the housing 100, achieving a final assembly position of the housing assembly 10 shown in FIG. 3. The cable recess 240 in the protective cover 200 can be used to receive a folded-over portion of the hinge 122 in the assembly position.

The cable recess 124 of the sealing device 120 and the cable recess 240 of the protective cover 200 constitute a cable bushing 124, 240 at the rear end 101 of the housing 100, terminating the sealing chamber 110 axially Ax towards the rear end 101. The cable recess 124 and the cable recess 240 overlap only in the axial direction Ax. The radial Ra directions of the cable recesses 124, 240 to the exterior are arranged so as to be offset relative to each other; the two cable recesses 124, 240 are provided so as to be rotated relative to each other radially Ra at an angle. In the shown embodiment, the cable recess 124 of the sealing device 120 and the cable recess 240 of the protective cover 200 are approximately 180° from each other. In other embodiments, other non-zero angles could be used. When the cable 50 is received in the cable bushing 124, 240, the rear end 101 of the housing 100 is sealed in a substantially light-impermeable manner.

Figure 4:
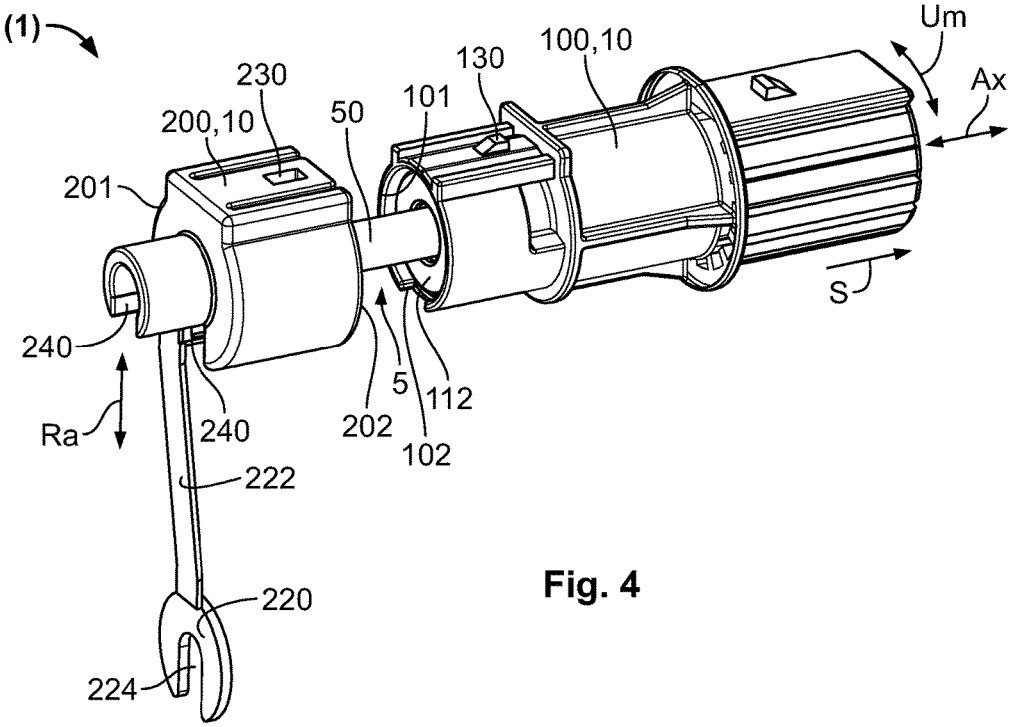
FIG. 4 is a perspective view of another electrical connector according to the invention in a pre-assembly state of a sealing device and a pre-assembly state of a protective cover.
Figure 5:
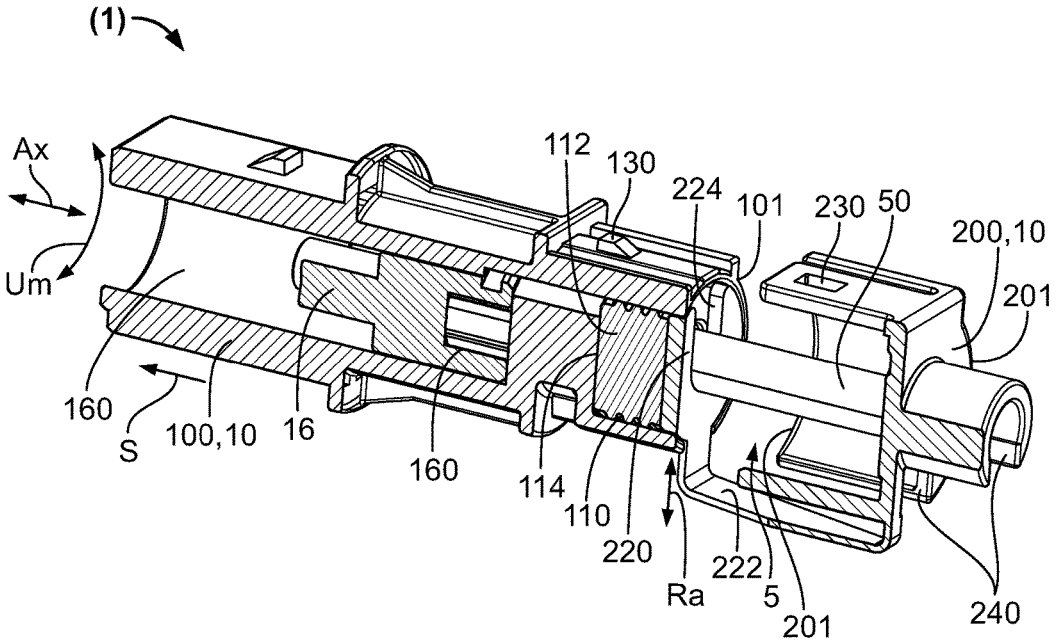
FIG. 5 is a sectional perspective view of the electrical connector of FIG. 4 in an assembled state of the sealing device and the pre-assembly state of the protective cover.
Figure 6:
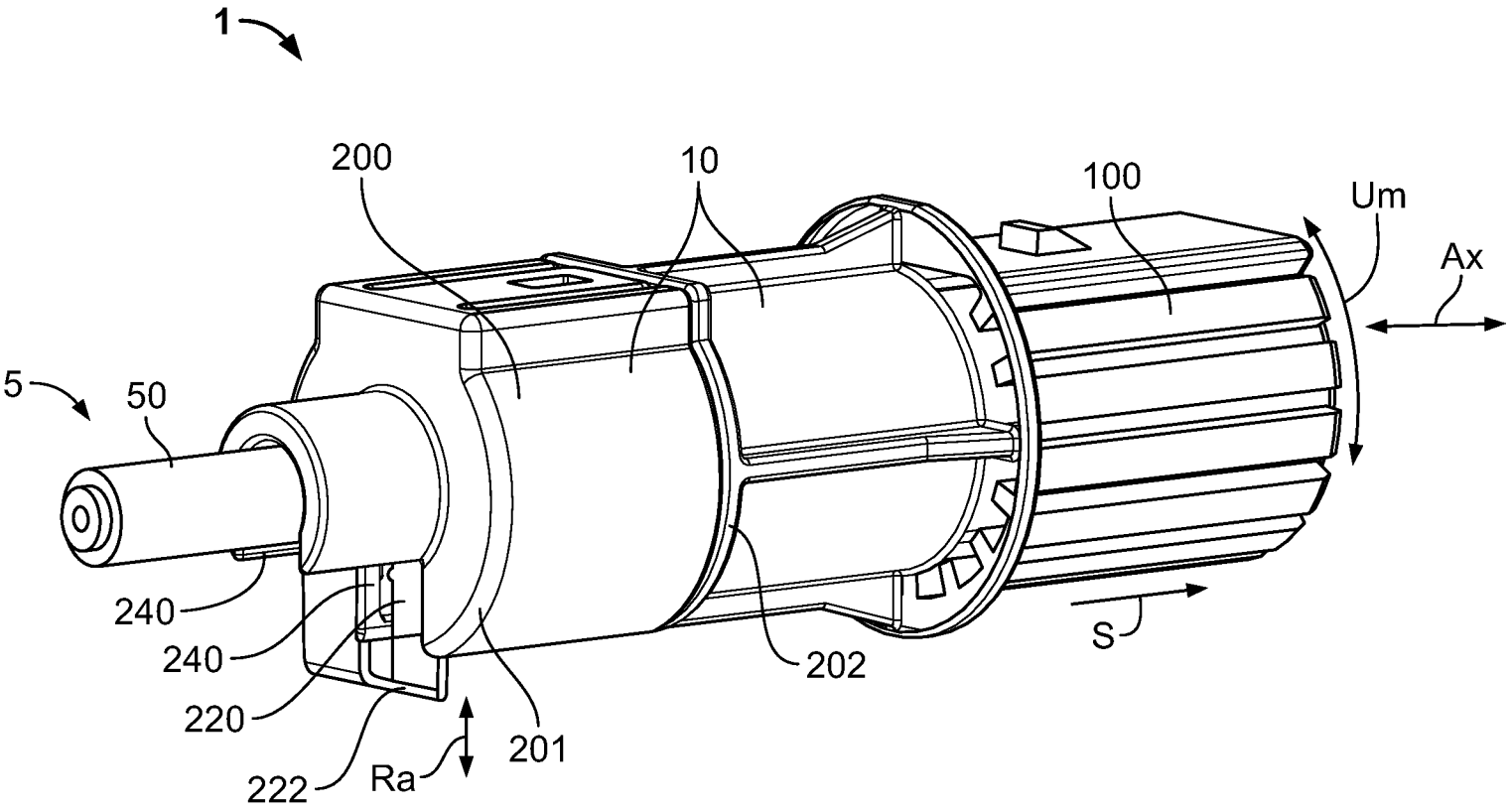
FIG. 6 is a perspective view of the electrical connector of FIG. 4 in a fully assembled state.

An electrical connector 1 according to a second embodiment of the invention is shown in FIGS. 4-6. Only differences from the embodiment shown in FIGS. 1-3 will be described in greater detail below.

Instead of connecting the sealing device 120 to the housing 100 as in the first embodiment, in the second embodiment, a sealing device 220 shown in FIGS. 4 and 5 is connected to the protective cover 200. The sealing device 220 is connected to the protective cover 200 via a hinge 222 at the rear end 201; the hinge 222 is planar with the rear end 201. In other embodiments, the sealing device 220 can be connected to a central portion or to an axially Ax front end 202 of the protective cover 200. A cable recess 224 of the sealing device 220 is constructed similarly to the cable recess 124 of the sealing device 120 of the housing 100 shown in FIGS. 1-3. As shown in FIGS. 4 and 5, the hinge 222 is connected to the protective cover 200 beside and adjacent the cable recess 240, and is therefore positioned offset from a central axis of the protective cover 200. An axially Ax extending portion of the hinge 222 has an offset in a peripheral direction Um or transverse direction.

In a pre-assembly state of the sealing device 220 shown in FIG. 4, the hinge 222 and the sealing device 220 extend radially Ra outward from the protective cover 200. So that the sealing device 220 can be folded onto and/or into the sealing chamber 110, a physical construction of the hinge 222 compensates for its offset position. The sealing device 220, similarly to the embodiment shown in FIGS. 1-3, is assembled over the cable 50 and covers a rear of the seal 112 as shown in FIG. 5. The protective cover 200 is subsequently assembled on the housing 100, achieving a final assembly position of the housing assembly 10 shown in FIG. 6. The cable recess 240 in the protective cover 200 can be used to receive a folded-over portion of the hinge 222 in the assembly position.

Figure 7:
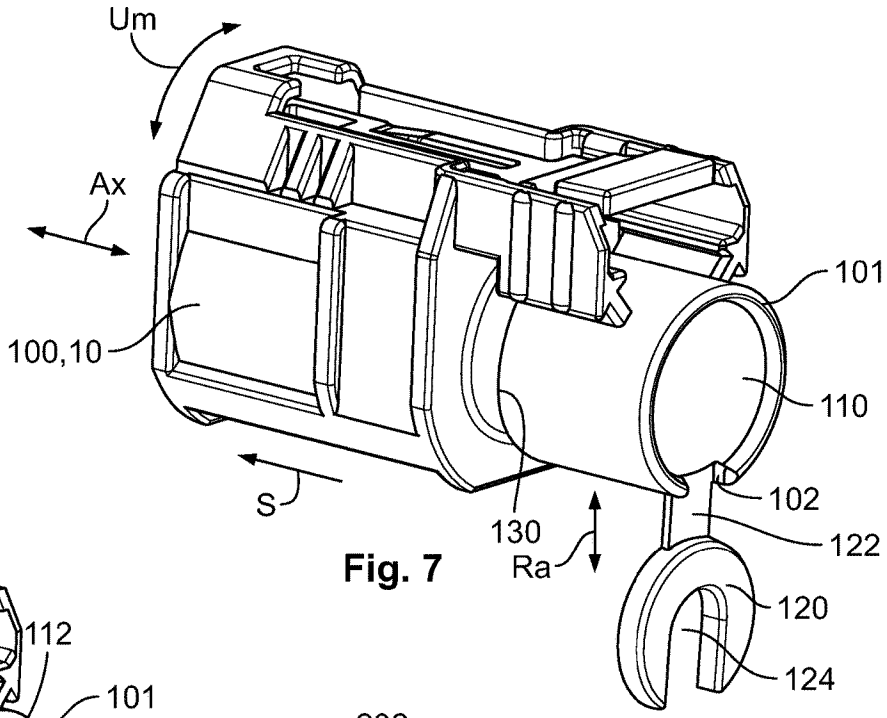
FIG. 7 is a perspective view of a housing with a sealing device according to the invention.
Figure 8:
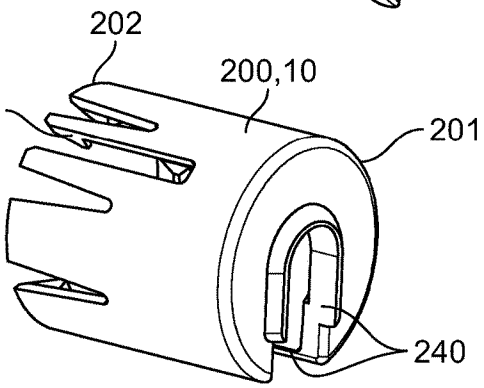
FIG. 8 is a perspective view of another electrical connector according to the invention having the housing of FIG. 7.
Figure 8:
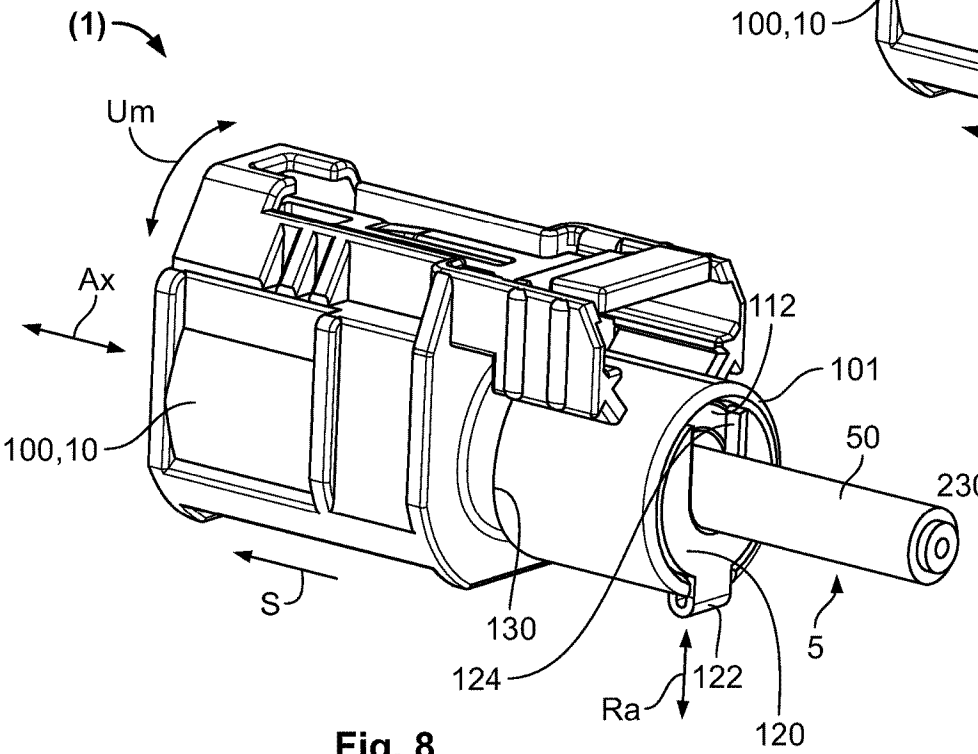
Figure 9:
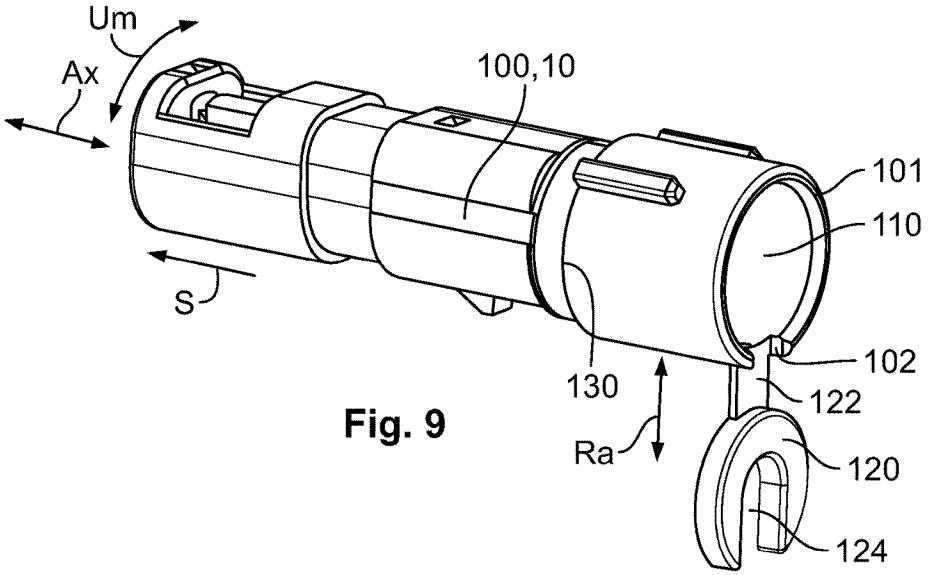
FIG. 9 is a perspective view of another housing with a sealing device according to the invention.
Figure 10:
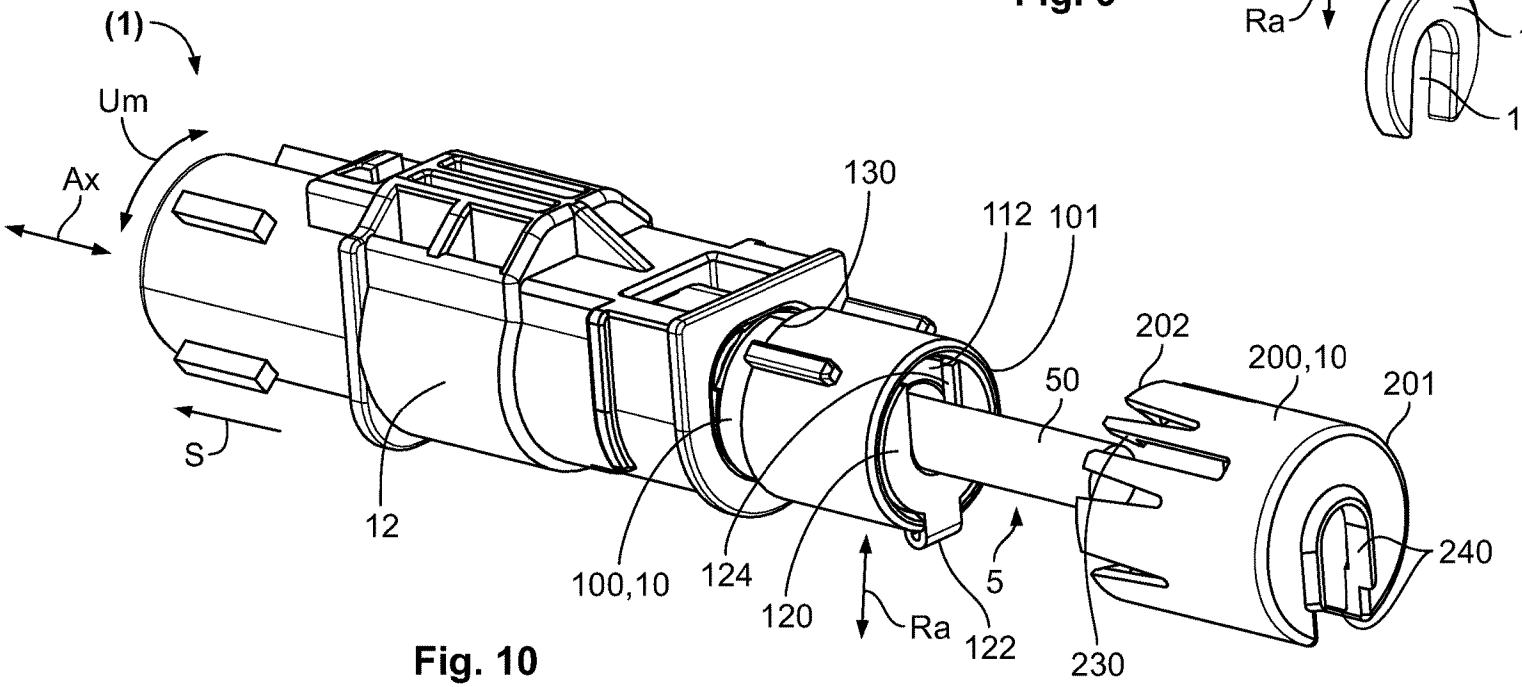
FIG. 10 is a perspective view of another electrical connector according to the invention having the housing of FIG. 9.
Figure 11:
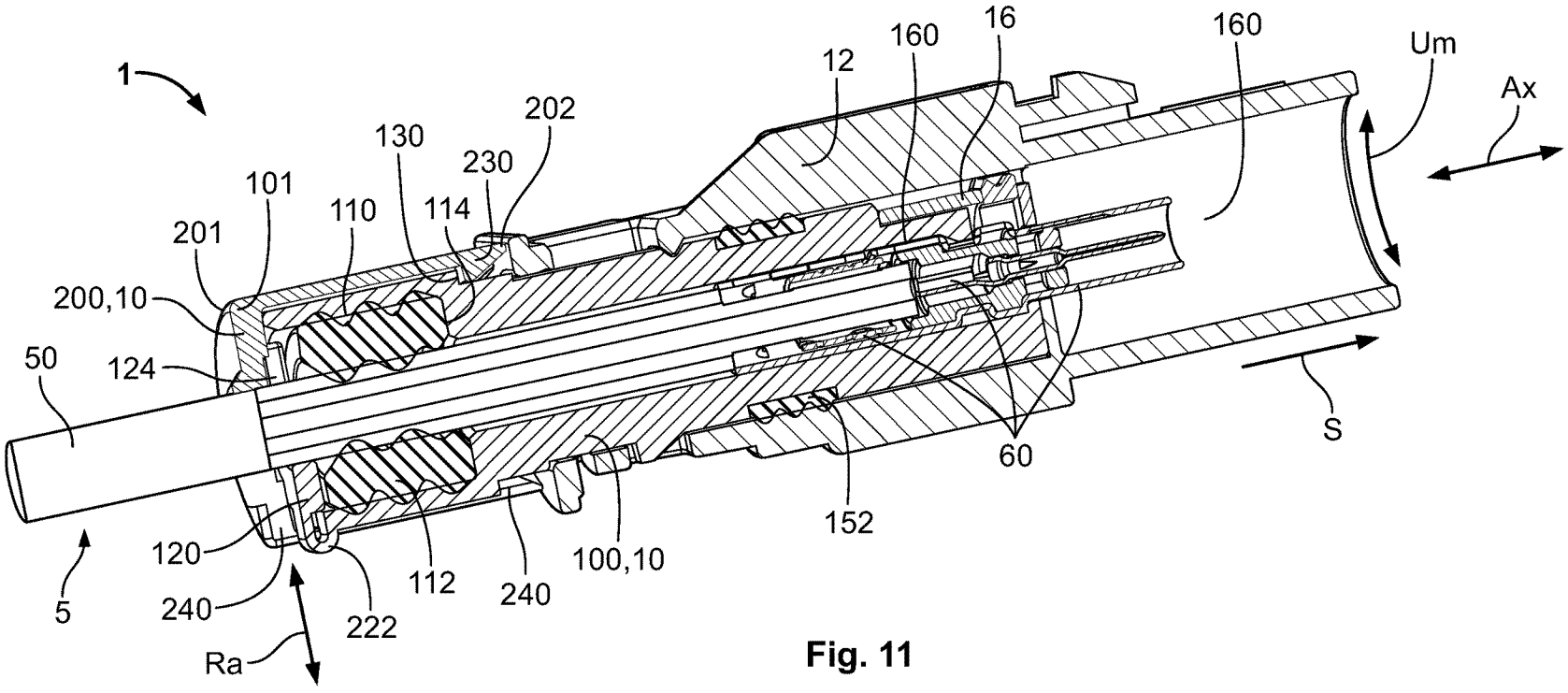
FIG. 11 is a sectional perspective view of the electrical connector of FIG. 10.
Figure 12:
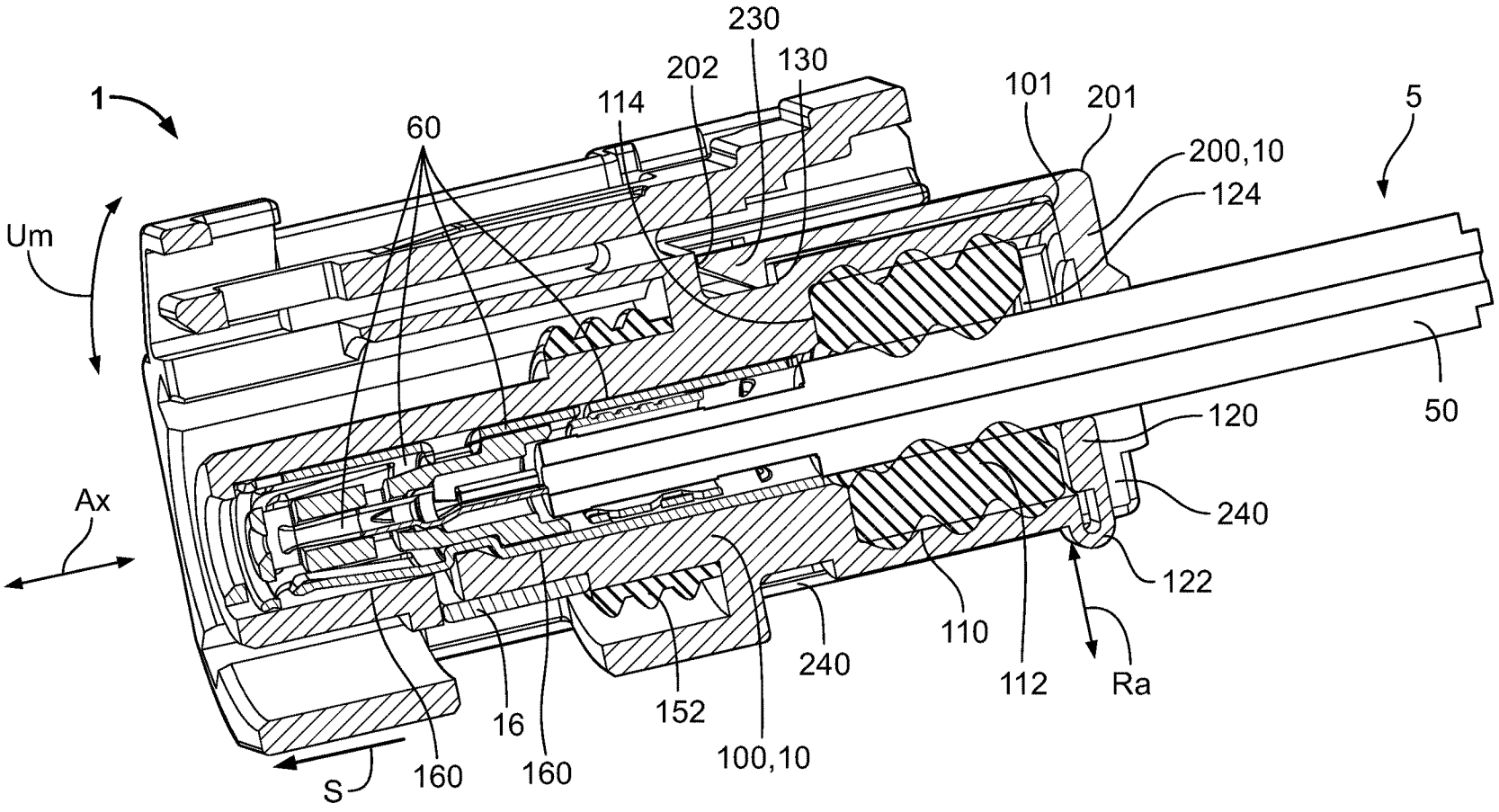
FIG. 12 is a sectional perspective view of the electrical connector of FIG. 8.

Two additional variations of the first embodiment of the invention, in which the sealing device 120 is connected to the housing 100, are shown in FIGS. 7-12. A plug housing 100 with a sealing device 120 and a plug connector 1 having the plug housing 100 are shown in FIGS. 7, 8, and 12. A receptacle housing 100 with a sealing device 120 and a receptacle connector 1 having the receptacle housing 100 are shown in FIGS. 9-11. The receptacle housing 100 shown in FIGS. 9-11 is disposed in an enclosure housing 12 during a final assembly step. The enclosure housing 12 may be an adapter. Alternatively, the enclosure housing 12 could be integrally formed with and part of the receptacle housing 100. As shown in FIGS. 11 and 12, a housing seal 152 is disposed between the housing 100 and enclosure housing 12. The housing seal 152 seals the respective contact chambers 160 when the receptacle connector 1 of FIG. 11 is mated with the plug connector 1 of FIG. 12.

What is claimed is:

1. A housing assembly for a waterproof connector, comprising:

a housing having a sealing chamber receiving a seal;

a sealing device movable to cover the seal in the sealing chamber, the sealing device having a cable recess extending in a plane of the sealing device from an approximate center of the sealing device in a radial direction through a perimeter of the sealing device; and a protective cover covering the seal and the sealing device, the sealing device connected to the housing or the protective cover by a hinge.

2. The housing assembly of claim 1, wherein the sealing device is positively-locked to the sealing chamber.

3. The housing assembly of claim 1, wherein the hinge is received in a recess at a rear end of the sealing chamber.

4. The housing assembly of claim 1, wherein the sealing device is completely received within the sealing chamber in an axial direction of the housing.

5. The housing assembly of claim 1, wherein, in an assembled state of the sealing device and the protective cover on the housing, a rear end of the housing is sealed in a substantially light-impermeable manner in an axial direction of the housing.

6. The housing assembly of claim 5, wherein, in the assembled state, the cable recess of the sealing device and a cable recess of the protective cover overlap each other and form a cable bushing.

7. The housing assembly of claim 6, wherein the cable recess of the protective cover extends from an approximate center of the protective cover in the radial direction through a perimeter of the protective cover.

8. The housing assembly of claim 1, wherein, in a pre-assembly state of the sealing device and the housing, the sealing device extends away from the housing or the protective cover.

9. The housing assembly of claim 8, wherein, in an assembly state of the sealing device and the housing, the sealing device is folded and positioned at the sealing chamber.

10. The housing assembly of claim 1, wherein the sealing device is connected to a rear end of the sealing chamber and extends radially outwards from the sealing chamber.

11. The housing assembly of claim 1, wherein the sealing device is connected to a rear end of the protective cover and extends radially outwards from the protective cover.

12. The housing assembly of claim 1, wherein the sealing device and the protective cover apply a mechanical pretensioning force to the seal.

13. The housing assembly of claim 1, wherein the sealing chamber is disposed at a cable outlet side of the housing.

14. The housing assembly of claim 1, wherein the protective cover has a cover catch engaging a housing catch of the housing.

15. A waterproof electrical connector, comprising:

an assembled cable; and a housing assembly sealing the assembled cable and including a housing having a sealing chamber receiving a seal, a sealing device movable to cover the seal in the sealing chamber, the sealing device having a cable recess extending in a plane of the sealing device from an approximate center of the sealing device in a radial direction through a perimeter of the sealing device, and a protective cover covering the seal and the sealing device, the sealing device connected to the housing or the protective cover by a hinge.

16. The electrical connector of claim 15, wherein the assembled cable extends through the protective cover, the sealing device, and the seal into a contact chamber of the housing.

17. The electrical connector of claim 15, wherein the assembled cable includes a coaxial cable and a connection mechanism electrically connected to the cable.

18. The electrical connector of claim 17, wherein the coaxial cable has a copper conductor or an aluminum conductor.

19. The electrical connector of claim 15, wherein the seal, the sealing device, and the protective cover are disposed directly adjacent to each other.

20. The electrical connector of claim 15, wherein the sealing device and the protective cover apply a mechanical pretensioning force to the seal.

21. The electrical connector of claim 15, further comprising an enclosure housing in which the housing is disposed.

22. The electrical connector of claim 16, wherein, in a pre-assembly state, the assembled cable extends through the seal and into the contact chamber and the sealing device extends away from the housing or the protective cover.

23. The electrical connector of claim 22, wherein, in an assembly state, the sealing device is folded over the assembled cable and positioned at the sealing chamber, the assembled cable is received in the cable recess of the sealing device.

* * * * *